US006268105B1

(12) United States Patent
Arakatsu et al.

(10) Patent No.: US 6,268,105 B1
(45) **Date of Patent: *Jul. 31, 2001**

(54) DYE-FIXING ELEMENT AND IMAGE-FORMING METHOD, USING A SPECIFIC DYE-MORDANT

(75) Inventors: Hiroshi Arakatsu; Nobuo Seto; Toshiki Taguchi, all of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/576,994

(22) Filed: May 24, 2000

(30) Foreign Application Priority Data

May 25, 1999 (JP) ..... 11-145592

(51) Int. Cl.[7] ..... G03C 8/26; G03C 8/56; G03C 8/40; G03C 8/32

(52) U.S. Cl. ..... 430/203; 430/213; 430/216; 430/941

(58) Field of Search ..... 430/213, 216, 430/941, 203

(56) References Cited

U.S. PATENT DOCUMENTS 6,010,819 1/2000 Arakatsu et al. ..... 430/216
6,106,991 * 8/2000 Taguchi et al. ..... 430/216

FOREIGN PATENT DOCUMENTS 11125889 5/1999 (JP) .

OTHER PUBLICATIONS

"Photographic processes and products", *Research Disclosure* No. 15162, Sep. 1977, pp. 77–87, 430/213.*

* cited by examiner

*Primary Examiner*—Richard L. Schilling

(57) ABSTRACT

There is disclosed a dye-fixing element utilizable to form an image by releasing or producing an image-forming dye or a precursor thereof in proportion or contraproportion to developed silver formed by development after imagewise exposing of a photosensitive silver halide and thereafter by diffusion or diffusive-transfer of the dye, which element comprises a polymeric dye mordant containing a recurring unit of the formula (A) and/or (B):

formual (A)

formual (B)

wherein $R_{12}$ and $R_{22}$ each are H or an alkyl group, $Y_1$ and $Y_2$ each are ←$CONR_4$—, ←COO— or ←$CH(OH)CH_2O$—, X is Cl, Br, I or OH, Z is an atomic group necessary to form a 5- to 7-membered heteroring together with the N, $R_{13}$ and $R_{23}$ each are H, $CH_3$, $C_2H_5$, or a halogen atom, and $R_4$ is H or an alkyl group having 1–4 carbon atoms, and the symbol ← is a bond on the side of the main chain of the polymer. There is also disclosed a method for forming a color image excellent in fastness to light without causing any color-mixing.

10 Claims, No Drawings

DYE-FIXING ELEMENT AND IMAGE-FORMING METHOD, USING A SPECIFIC DYE-MORDANT

FIELD OF THE INVENTION

The present invention relates to an improvement in fastness to light of a dye-fixing element in an image-forming system using a photosensitive element and the dye-fixing element. More particularly, the present invention relates to a method for forming an image which is improved in fastness to light in a method for forming an image wherein an image-forming dye is produced and released by exposure and development of a photosensitive silver halide and the image-forming dye is diffused or transferred from a photosensitive layer to an image-receiving layer thereby forming the image. The present invention relates also to an image-receiving element utilizable for an image-forming method wherein an image-forming dye is formed or released by exposure and development of a photosensitive silver halide and the image-forming dye is diffused or diffusion-transferred from a photosensitive layer to an image-receiving layer thereby forming the image.

BACKGROUND OF THE INVENTION

It is known that a photographic material for a color-diffusive transfer method (the so-called instant photography), a heat-development color-diffusive transfer method and a method employing a photosensitive microcapsule are known as a method for forming an image wherein a photosensitive silver halide is exposed and developed to form or release and diffuse an image-forming dye followed by transfer of the dye to form an image.

Images obtained according to these methods are generally poor in fastness to light as compared with those obtained according to conventional photographic methods so that a variety of methods have been proposed hitherto for enhancing fastness to light.

Mentioned as one of the methods is the use of a UV-absorbing agent. This method comprises decreasing the light quantity irradiated to a color image by the UV-absorbing agent to enhance fastness to light. As a matter of course, however, this method inhibited fading due to ultraviolet light but utterly failed to inhibit fading due to visible light. In addition, a problem arises in fading or discoloring of an image caused by the UV-absorbing agent.

It is secondarily or incidentally necessary to use a relatively large amount of a UV-absorbing agent to sufficiently improve the fastness to light. The use of a large amount of UV-absorbing agent results in an increase of film thickness so that it causes a problem such as increase in transfer time, deterioration of resolution and poor turn of processing as well as a problem such as deterioration of film strength and precipitation of the UV-absorbing agent.

What is more, the effect of a fluorescent brightening agent is lowered to decrease whiteness and the like principle problem, thus failing to impart sufficient fastness to light to an image.

A discussion is also made on various fade-preventing agents employed in the so-called conventional photographic system. However, the fade-preventing agents useful in the conventional photographic system are oil-soluble. On the other hand, dyes used in the photographic method of the present invention wherein the dyes are transferred to form images are chiefly water-soluble. Accordingly, a satisfactory effect could not be achieved in the present invention wherein the fade-preventing agents were absent in a position where they could sufficiently react with the dyes on account of the layer construction.

In the dye-diffusive transfer system, effective fade-preventing agent are disclosed in JP-A-62-1441 ("JP-A" means unexamined published Japanese patent application). The invention in the publication discloses dye image receiving materials containing piperidines in color diffusion-transfer photography, but fails to disclose radicals and could not achieve sufficient effects.

As another invention, JP-B-49-20974 ("JP-B" means examined Japanese patent publication) discloses addition of hindered piperidines and/or radicals thereof to a photosensitive material and also discloses that the effect is also attained in the dye-diffusive transfer method. In case these additives are added directly to a dye-fixing element, however, color mixing will be generated and photographic characteristic change will also take place, thus failing to obtain a good color image.

SUMMARY OF THE INVENTION

It is an object of the present invention to provide a method for forming a color image excellent in fastness to light without causing any color-mixing in methods of forming an image wherein an image-forming dye or a precursor thereof is released or produced by exposure and development of a photosensitive silver halide and the dye is diffused or transferred to form the image.

It is another object of the present invention to provide an image-forming material capable of forming an image excellent in fastness to light without causing color-mixing in the method of forming an image.

It is still another object of the present invention to provide a dye-fixing element utilizable for the method for forming an image.

It is still further object of the present invention to provide a dye-fixing element comprising a specific polymeric dye mordant.

Other and further objects, features, and advantages of the invention will appear more fully from the following description.

DETAILED DESCRIPTION OF THE INVENTION

As a result of extensive research for solving the above problem, it has now been found that an image can significantly be improved in fastness to light and moreover color-mixing can also be prevented by the use of even a small amount of a polymeric dye mordant wherein a radical of a piperidine derivative may not be diffused on development in a photosensitive element while maintaining water-solubility of the radical of the piperidine derivative. The present invention has been accomplished on the basis of the above finding.

Thus, the objects of the present invention have been attained by the following dye-fixing element and the method for forming an image.

(1) A dye-fixing element utilizable for formation of an image by releasing or producing an image-forming dye or a precursor thereof in proportion or contraproportion to developed silver formed by development after imagewise exposing of a photosensitive silver halide and thereafter by diffusion or diffusive-transfer of the dye, which element comprises a polymeric dye mordant containing a recurring unit represented by the following formula (A) and/or a recurring unit represented by the following formula (B):

formula (A)

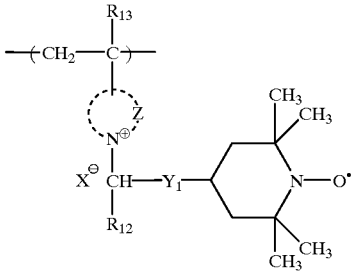

formula (B)

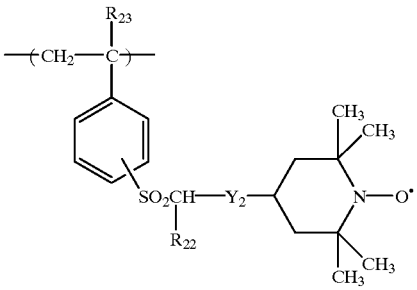

wherein $R_{12}$ and $R_{22}$ each stand for a hydrogen atom or an alkyl group, $Y_1$ and $Y_2$ each stand for ←$CONR_4$—, ←COO— or ←$CH(OH)CH_2O$—, X stands for a chlorine atom, a bromine atom, an iodine atom or a hydroxyl group, Z stands for an atomic group necessary for forming a 5- to 7-membered hetero ring together with the nitrogen atom, $R_{13}$ and $R_{23}$ each stand for a hydrogen atom, a methyl group, an ethyl group, or a halogen atom, and $R_4$stands for a hydrogen atom or an alkyl group having 1 to 4 carbon atoms, and wherein the symbol ← stands for a bond on the side of the main chain of the polymer.

(2) The dye-fixing element according to the paragraph (1), wherein a photosensitive material and/or the dye-fixing element is incorporated with a base or a precursor thereof and the material and the element are overlapped each other with a small amount of water and heated after imagewise exposing thereby effecting development.

(3) The dye-fixing element according to the paragraph (1) or (2), wherein the dye-mordant contains a recurring unit represented by the formula (A) and/or a recurring unit represented by the formula (B) in an amount of at least 0.5 mol % based on the total recurring unit being 100 mol %.

(4) The dye-fixing element according to the paragraph (1), (2) or (3), wherein the dye-mordant is represented by the following formula (C):

formula (C)

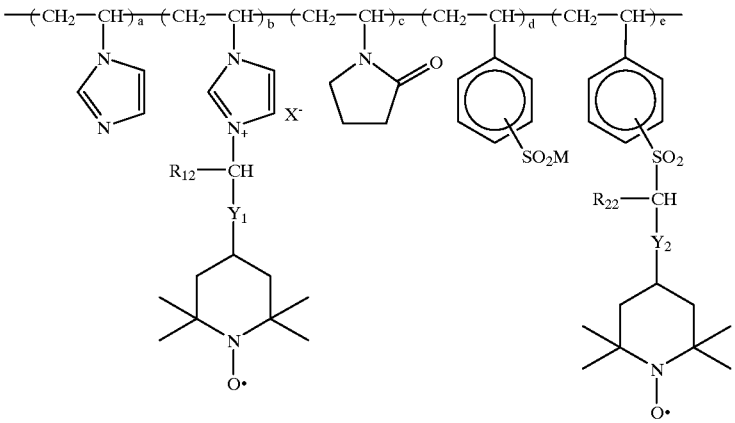

wherein $Y_1$, $Y_2$, $R_{12}$, $R_{22}$ and X have the same meanings as given in the formulas (A) and (B), M stands for an alkali metal ion, a is 50–99 mol %, a total of b and e is 1–10 mol %, c is 0–49 mol %, and d is 0–10 mol %, with the proviso that a, b, c, d and e are so selected that the total may become 100 mol %.

(5) A method for forming an image wherein a photosensitive silver halide is imagewise exposed and developed, an image-forming dye or a precursor thereof is released or produced in proportion or contraproportion to the developed silver and the image is formed by diffusion or diffusive transfer of the dye, which method comprises using the dye-fixing element according to any one of the paragraphs (1)–(4).

Below is an explanation on the compounds used in the present invention.

The compounds used in the present invention are dye-mordants containing a recurring unit represented by the formula (A) and/or a recurring unit represented by the formula (B) (a recurring unit containing a residue bonded to a 2,2,6,6-tetramethylpiperidinoxy radical).

The formulas (A) and (B) are more fully explained hereunder.

Below is an explanation on $R_{12}$ and $R_{22}$ in these formulas. The alkyl group may preferably be a linear, branched chain or cyclic alkyl group having 1–7 carbon atoms and may be substituted or unsubstituted. Mentioned, for example, are methyl group, ethyl group, isobutyl group, and methoxyethyl group. In the aspect of the effect of the present invention, $R_{12}$ and $R_{22}$ each are preferably a hydrogen atom.

In aspect of the effect of the present invention, $Y_1$ and $Y_2$ each are preferably ←$CONR_4$— or ←$CH(OH)CH_2$—, and more preferably ←CONH—.

In aspect of the effect of the present invention, X is preferably a chlorine atom, a bromine atom or a hydroxyl group and more preferably a chlorine atom.

Z is an atomic group capable of forming a 5–7 membered hetero ring together with the nitrogen atom whereby the hetero ring may be a saturated ring, an unsaturated ring or an aromatic ring, such as piperidine ring, pyrolidine ring, morpholine ring, pyrazole ring or imidazole ring. In aspect of the effect of the present invention, Z forms preferably an aromatic ring and more preferably an aromatic ring including two nitrogen atoms in the ring thereof. In this case, the main polymeric chain is preferably bound to another nitrogen atom (not the quaternary nitrogen atom) and most preferably an imidazole ring.

Each of $R_{13}$ and $R_{23}$ is preferably a hydrogen atom, a methyl group, an ethyl group, and more preferably a hydrogen atom or a methyl group, and most preferably a hydrogen atom.

In case the compound for use in the present invention contains an aliphatic moiety therein, the aliphatic moiety may be a linear, branched chain or cyclic structure and may be saturated or unsaturated. For example, the moiety stands for an alkyl, alkenyl, cycloalkyl or cycloalkenyl which may be substituted or unsubstituted. On the other hand, when the compound contains an aryl moiety therein, the aryl moiety may be a monocyclic or condensed ring and may be substituted or unsubstituted. In case the compound contains a heterocyclic ring moiety therein, the moiety contains a hetero atom or atoms (for example, a nitrogen atom, a sulfur atom, or an oxygen atom) in the ring thereof and may be a saturated ring or an unsaturated ring or may be a single ring or a condensed ring with or without a substituent or substituents.

In aspect of the effect of the present invention, the case wherein $R_{12}$ is a hydrogen atom, $R_{13}$is a hydrogen atom, $Y_1$ is ←CONH— or ←$CH(OH)CH_2O$—, Z is an atomic group forming an imidazole ring, and X is a chlorine atom, and the case wherein $R_{22}$ is a hydrogen atom, $R_{23}$ is a hydrogen atom, and $Y_2$ is ←CONH—, are preferable.

A substituent in case of any of the groups in the compound for use in the present invention carrying the substituent may be any of the substitutable groups. Illustrative of the substituent are, for example, an aliphatic group, an aryl group, a heterocyclic group, an acyl group, an acyloxy group, an acylamino group, an aliphatic oxy group, an aryloxy group, a heterocyclic oxy group, an aliphatic oxycarbonyl group, an aryloxycarbonyl group, a heterocyclic oxycarbonyl group, a carbamoyl group, an aliphatic sulfonyl group, an arylsulfonyl group, a heterocyclic sulfonyl group, an aliphatic sulfonyloxy group, an arylsulfonyloxy group, a heterocyclic sulfonyloxy group, a sulfamoyl group, an aliphatic sulfonamide group, an arylsulfonamide group, a heterocyclic sulfonamide group, an aliphatic amino group, an arylamino group, a heterocyclic amino group, an aliphatic oxycarbonylamino group, an aryloxycarbonylamino group, a heterocyclicoxycarbonylamino group, an aliphatic sulfinyl group, an arylsulfinyl group, an aliphatic thio group, an arylthio group, a hydroxyl group, a cyano group, a sulfo group, a carboxyl group, an aliphatic oxyamino group, an aryloxyamino group, a carbamoylamino group, a sulfamoylamino group, a halogen atom, a sulfamoylcarbamoyl group, a carbamoylsulfamoyl group, a dialiphatic oxyphosphinyl group and a diaryloxyphosphinyl group.

The polymeric compound used in the present invention is not only a homopolymeric one having a recurring unit of the formula (A) or (B) but also may be a copolymeric one having recurring units of the formulas (A) and (B). Alternatively, the compound may be another type of polymeric compound wherein a recurring unit or units of the formulas (A) and/or (B) are copolymerized with another recurring unit(s) to form a copolymeric structure.

Preferable as a compound capable of forming such copolymeric structure are, for example, vinylhetrocyclic compounds, vinyl ethers, styrenesulfonic acids, styrenesulfinic acids, acrylamides, and methacrylamides. More preferable are vinylheterocyclic compounds, styrenesulfonic acids and styrenesulfinic acids. Most preferable are vinylheterocyclic compounds and styrenesulfinic acids. Illustrative of the vinylheterocyclic compounds are preferably N-vinylimidazole and N-vinylpyrrolidone.

In aspect of the effect of the present invention, the polymeric compound for use in the present invention contains preferably not only a recurring unit or units of the formula (A) and/or (B) but also at least one of the other monomeric units. More preferable is the case wherein at least two recurring units are contained. Most preferable are those having a copolymeric structure copolymerized with a recurring unit derived from N-vinylimidazole and/or N-vinylpyrrolidone and/or styrenesulfinic acid and/or styrenesulfonic acid.

An weight average molecular weight of the polymeric compound for use in the present invention containing a recurring unit represented by the formula (A) and/or a recurring unit represented by the formula (B) is within the range of generally 1,000–1,000,000, preferably 2,000–750,000, and more preferably 3,000–500,000. It is noteworthy, however, that these values are not necessarily critical for attaining the effect of the present invention.

Among the polymeric dye mordants containing a recurring unit represented by the formula (A) and/or a recurring unit represented by the formula (B), a preferable one is a dye mordant represented by the formula (C).

A preferable range of the total of b and e of the formula (C) is 1–5 mol %, a preferable range of c is 20–40 mol % and a preferable range of d is 0–5 mol %. Illustrative of the alkali metal ion represented by M are Na and K. Among these, K is preferable.

The bonding state of each construction unit of the polymer shown by the formula (C) is not restricted herein to either of the types of a block polymer or random polymer.

The mordant shown by the formula (C) can be synthesized, for example, by reacting a vinyl polymer containing a unit in which imidazole and/or benzenesulfinic acid (salt) has been bonded to vinyl group with a chloride of a hindered piperidinoxy radical. The details of this reaction is disclosed in Japanese Patent Appln. No. Hei. 11-66922.

Examples of the polymer having the recurring unit represented by formula (A) and/or the recurring unit represented by formula(B) for use in the present invention are shown below, but the invention is not limited to those exemplified compounds.

(1)
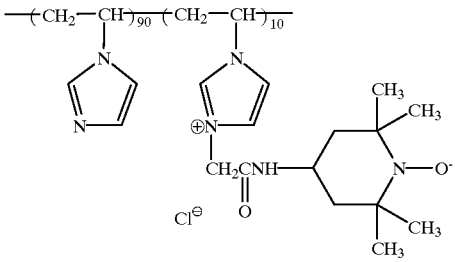
(2)
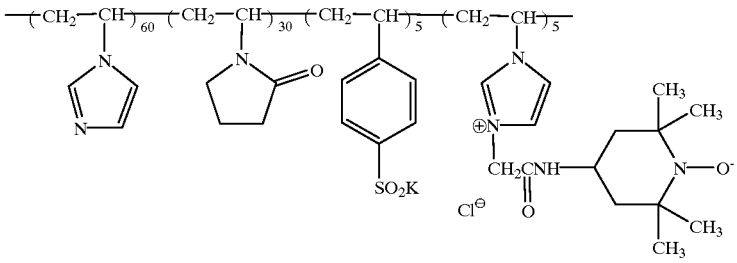
(3)
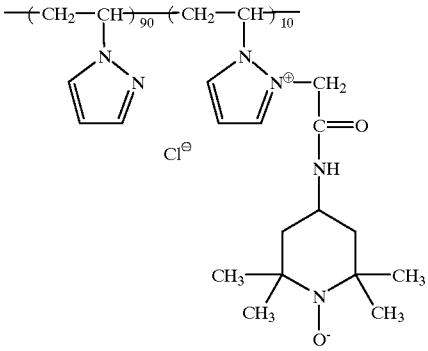
(4)
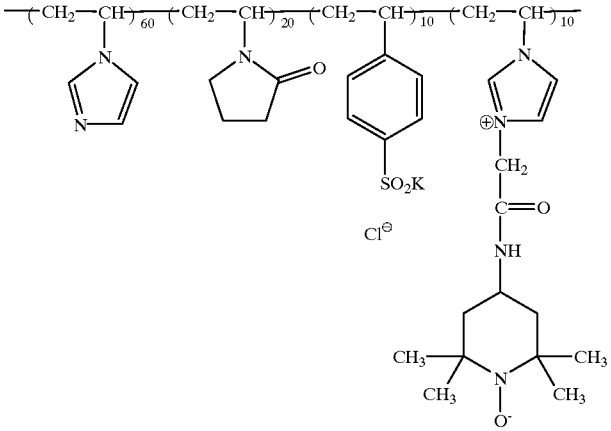

-continued
(5)
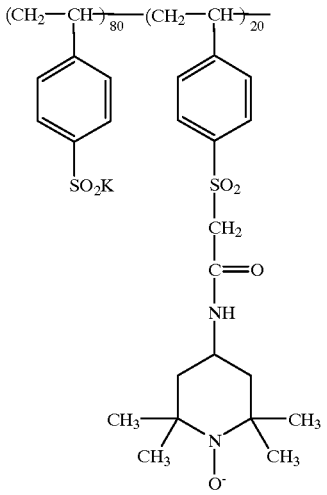
(6)
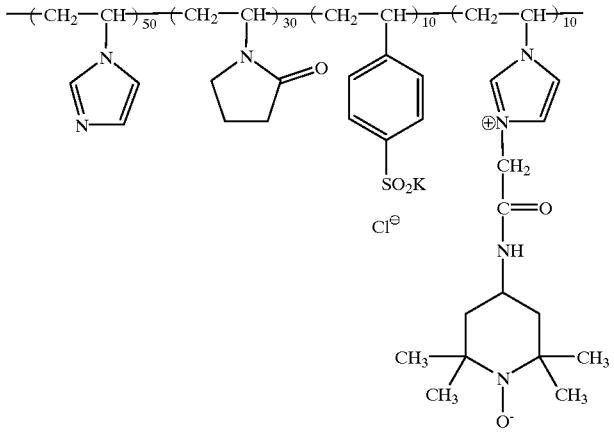
(7)
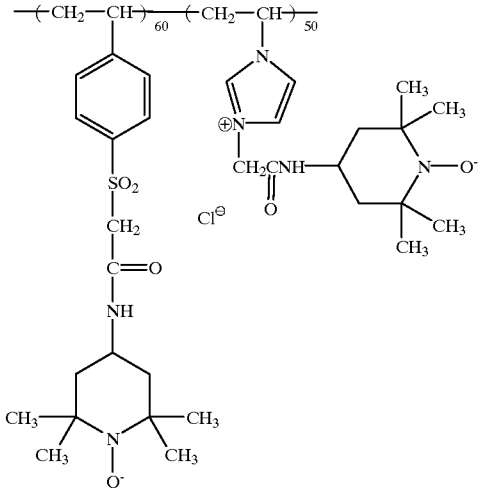

-continued
(8)
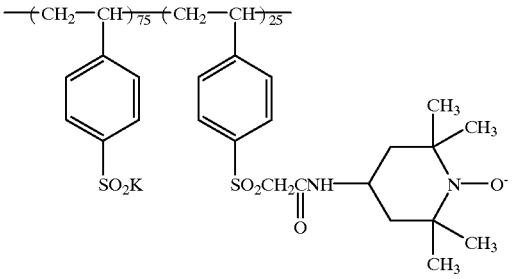
(9)
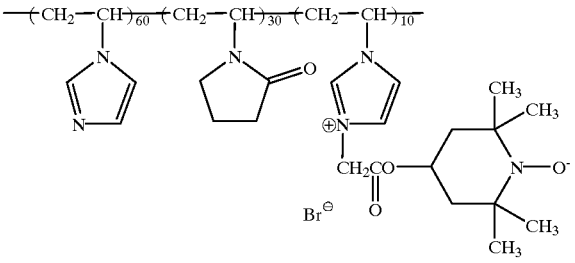
(10)
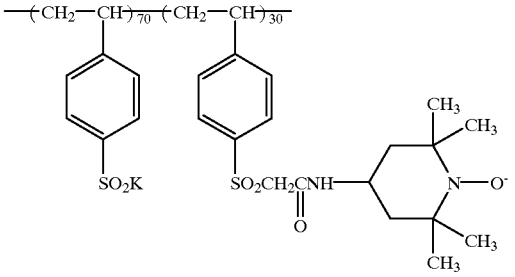
(11)
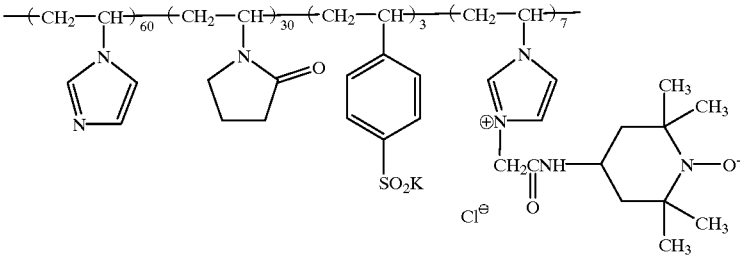
(12)
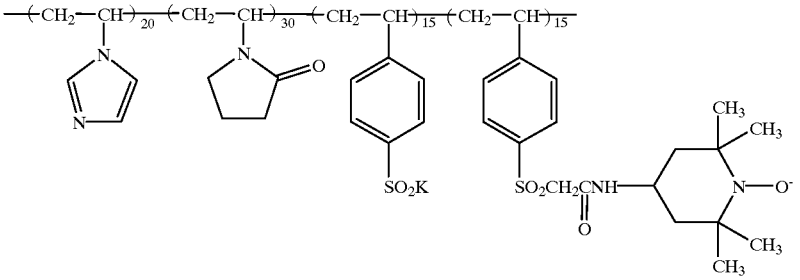

-continued (13)

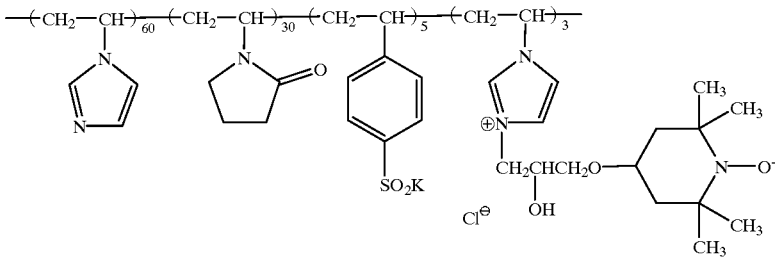

(14)

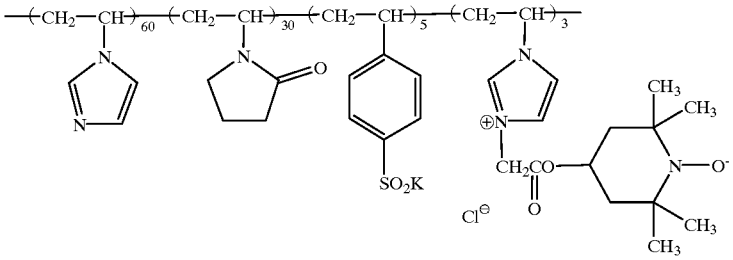

(15)

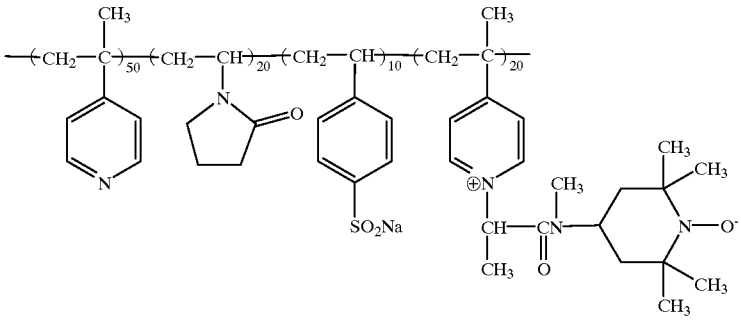

The amount of the mordant for use in the present invention to be added is preferably within the range of at least 0.1 $g/m^2$ but not more than 10 $g/m^2$, and more preferably within the range of at least 1 $g/m^2$ but not more than 5 $g/m^2$. No particular limitation exists in the contents of a recurring unit represented by the formula (A) and/or a monomeric unit represented by the formula (B). In proportion to the increase in the amount of a recurring unit represented by the formula (A) and/or a monomeric unit represented by the formula (B) introduced, however, coloring caused by the radical becomes significant. In case the amount of unit introduced is decreased, the degree of improvement in fastness to light tends to become poor. Accordingly, a preferable amount of the unit introduced is 0.01–10 and more preferably 0.1–3 in terms of molar ratio for the dye to be mordanted.

The mordant for use in the present invention may be added to any of the layers in such manner that it may be added to a single layer or plural layers. A plurality of the mordant for use in the present invention may be used together or may jointly be used with those other than the present invention. In particular, the conjoint use of a mordant chemically bonded to a hindered piperidine in a similar manner to the synthesis of the mordant for use in the present invention wherein a hindered piperidinoxy radical is chemically bonded is especially preferable in aspect of enhancing fastness of image to light and reducing stain caused by the radical.

The mordant for use in the present invention can jointly be used with another fade-preventing agent(s). These fade-preventing agents may be added to films or added in the form of being combined with the mordant. The mordant for use in the present invention may be used in combination with a UV-absorbing agent added or other fade-preventing means such as a laminate.

As a method of adding the mordant for use in the present invention, the mordant may be added in the form of an aqueous solution or may be added in the form of a solution in an organic solvent, such as alcohols and ketones, or a mixture solvent thereof with water if these solution would not be separated when mixed with a coating solution. It is also possible to add the mordant dissolved in an acid or a base. Further, it is also possible to add the mordant emulsified and dispersed in water or various solvents or in the form of a solid dispersion or latex.

The image-fixing element used in the present invention has at least a layer for fixing a dye for forming an image on a base, and to said dye-fixing layer is added the mordant. Further, if necessary, a surface protective layer, a timing layer, and an acid-neutralizing layer may be provided thereon, and a binder, a base-generating agent, a heat solvent, a whitening agent, an antifoggant, a stabilizer, a hardener, a plasticizer, a high-boiling organic solvent, a coating aid, a surfactant, an antistatic agent, a matting agent, a slip agent, an antioxidant, etc. may be contained therein.

Specifically, for example, a dye-fixing element described in JP-A-8-304982, a dye-image-receiving material described in JP-A-9-5968, an image-receiving material described in JP-A-9-34081, an image-receiving element described in JP-A-10-142765, and an image-receiving element (dye-fixing element) described in JP-A-9-152705 can be mentioned and more preferable embodiments are also described in them.

The light-sensitive material used in the present invention has, basically, a light-sensitive silver halide, a binder, and a dye-providing compound, on a base; and it may contain, if necessary, a chemical sensitizer, a sensitivity increaser, a spectral sensitizer, a supersensitizer, a whitening agent, an antifoggant, a stabilizer, a light absorber, a filter dye, a hardener, a base-generating agent, a plasticizer, a high-boiling organic solvent, a coating aid, a surfactant, an antistatic agent, a matting agent, and the like.

Specifically, a heat-developable color light-sensitive material described in JP-A-9-15805, a diffusion transfer silver halide light-sensitive material described in JP-A-9-152705, a color light-sensitive material described in JP-A-9-90582, a heat-developable color light-sensitive material described in JP-A-9-34081, and a color diffusion transfer light-sensitive material described in JP-A-10-142765 can be mentioned, and more preferable embodiments are also described in them.

In the present invention, an alkali processing composition can be used, if necessary. The alkali processing composition is spread uniformly between the light-sensitive element and the image-receiving element after the exposure of the light-sensitive element, to carry out development of the light-sensitive layer. The alkali processing composition contains an alkali and a developing agent, and further contains, if necessary, a thickening agent, a development accelerator, a development inhibitor, an antioxidant, or the like. Specifically, the processing composition described in JP-A-10-142765 corresponds to the alkali processing composition, and more preferable embodiments are also described therein.

In the present invention, as a base (support) of a light-sensitive material or an image-fixing element, can be mentioned photographic bases, such as papers and synthetic polymers (films), as described in "Shashin Kogaku no Kiso —Ginen Shashin-hen—," edited by Nihon Shashin-gakkai and published by Korona-sha, 1979, pages (223) to (240). Specifically, use can be made, for example, of polyethylene terephthalates (PETs), polyethylene naphthalates (PENs), polycarbonates, polyvinyl chlorides, polystyrenes, polypropylenes, polyimides, celluloses (e.g., triacetylcellulose); those obtained by incorporating a pigment, such as titanium oxide, into films made of these; synthetic papers made from polypropylenes or the like by the film method; papers made by mixing synthetic resin pulps, for example, of polyethylenes, with natural pulp; Yankee paper, baryta paper, coated papers (particularly, cast-coated papers), metals, cloths, glasses, ceramics, etc.

These may be used singly or may be used in the form of a base one or both of whose surfaces are laminated with a synthetic polymer, such as polyethylenes, PETs, polyesters, and polystyrenes.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

The surface of these bases may be coated with a hydrophilic binder plus a semiconductive metal oxide, such as tin oxide and alumina sol, carbon black, and another antistatic agent.

Further, for the purpose of improving wettability of the coating solution and improving adhesion between the coated film and the base, gelatin and a polymer, such as PVA, are also preferably applied to the surface of these bases previously.

The thickness of the base varies depending on the purpose of the use (application), and it is generally 40 $\mu$m or more, but 400 $\mu$m or less. However, in the case of a method wherein an image is formed using elements coated on two or more separate bases, preferably the base in which the image on that element is not finally used, is a base thinner than the thickness in the above range, i.e., a base having a thickness of 5 $\mu$m or more, but 250 $\mu$m or less. As the thinner base, use can be made, for example, of a film of PET on which aluminum is vacuum-evaporated.

Particularly when heat resistance and curling properties are severely demanded, as bases for light-sensitive materials, use can be preferably made of bases, as described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129, and JP-A-7-219144.

Example methods of exposing the light-sensitive material to light and recording an image, include a method wherein a landscape, a man, or the like is directly photographed by a camera or the like; a method wherein exposure to light is carried out through a reversal film or a negative film using, for example, a printer or an enlarging apparatus; a method wherein an original picture is subjected to scanning exposure through a slit by using an exposure apparatus of a copying machine or the like; a method wherein light-emitting diodes, various lasers, or the like are allowed to emit light, to carry out exposure of image information, through electrical signals; and a method wherein image information is outputted to an image display apparatus, such as a CRT, a liquid crystal display, an electroluminescence display, and a plasma display, and exposure is carried out directly or through an optical system.

Light sources that can be used for recording an image on the light-sensitive material, as mentioned above, include natural light, and light sources and exposure methods as described in U.S. Pat. No. 4,500,626, column 56, JP-A-2-53378, and JP-A-2-54672, such as a tungsten lamp, a light-emitting diode, a laser light source, and a CRT light source.

Further, use can be made of a light source in which a green-light emitting diode and a red-light emitting diode are used in combination, with a blue-light emitting diode that is remarkably developed recently. Particularly, exposure apparatuses described in JP-A-7-140567, JP-A-7-248549, JP-A-7-248541, JP-A-7-295115, JP-A-7-290760, JP-A-7-301868, JP-A-7-301869, JP-A-7-306481, and JP-A-8-15788 can be preferably used.

Further, image-wise exposure can be carried out by using a wavelength-converting element that uses a nonlinear optical material and a coherent light source, such as laser rays, in combination. Herein the term "nonlinear optical material" refers to a material that can develop nonlinearity between the electric field and the polarization that appears when subjected to a strong photoelectric field, such as laser rays; and as the material, use can be preferably made of inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and JP-A-62-210432. As the form of the wavelength-converting element, for example, a single crystal optical waveguide type and a fiber type are known, both of which are useful.

Further, as the above image information, can be employed, for example, image signals obtained from video cameras, electronic still cameras, and the like; television signals, represented by Nippon Television Singo Kikaku (NTSC); image signals obtained by dividing an original picture into a number of picture elements by a scanner or the like; and image signals produced by a computer, represented by CG or CAD.

The light-sensitive material and/or the dye-fixing element of the present invention can be used in various applications. For example, the dye-fixing element after the heat-development transfer can be used as a positive or negative color printing material. Further, by using a light-sensitive material wherein a black dye-providing substance or a mixture of yellow-, magenta-, and cyan-dye-providing substances is used, it can be used as a black and white positive or negative printing material, a material for printing, such as a light-sensitive material for lithography, or a material for radiography. Particularly, if it is used as a material for obtaining a print from a shooting (photographing) material, preferably a shooting material having an information recording function, as disclosed in JP-A-6-163450 and JP-A-4-338944, is used to expose the light-sensitive material for use in the present invention, to form a print on the dye-fixing element of the present invention by heat-development transfer. As this printing method, methods described in JP-A-5-241251, JP-A-5-19364, and JP-A-5-19363 can be used.

Further, by desilvering suitably the light-sensitive material after the heat-development transfer, it can be used as a shooting material. In that case, as the base, for example, a base having a magnetic substance layer, as described in JP-A-4-124645, JP-A-5-40321, JP-A-6-35092, or JP-A-6-317875, is preferably used to record shooting information or the like.

The light-sensitive material and/or the dye-fixing element of the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is generally about 50 to 250° C., and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature, and it is preferably particularly 50° C. or more, but upto a temperature lower by about 10° C. than the temperature of the heat development process.

Although the transfer of the dye can be brought about only by heat, a solvent may be used to accelerate the dye transfer. Further, it is also useful to use a method described, for example, in U.S. Pat. No. 4,704,345, U.S. Pat. No. 4,740,445, and JP-A-61-238056 wherein the development and the transfer are carried out at the same time or successively by heating in the presence of a small amount of a solvent (particularly water). In this system, the heating temperature is preferably 50° C. or more, but upto the boiling point of the solvent, and for example, in the case wherein the solvent is water, the heating temperature is preferably 50° C. to 100° C.

Examples of the solvent that is used for acceleration of development and/or for diffusion transfer of dyes, include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complex-forming compound with a hardly-soluble metal salt, a mildew-proofing agent, and an antifungus agent may be contained in the solvent.

As the solvent to be used in these heat development and diffusion transfer steps, water is preferably used, and the water may be any water that is generally used. Specifically, for example, distilled water, tap water, well water, and mineral water can be used. In the heat-development apparatus in which the light-sensitive material and the dye-receiving element of the present invention are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-210555 may be used.

These solvents may be used in such a way that they are applied to the light-sensitive material or the dye-fixing element, or to both of them. The amount of the solvent to be used may be the weight of the solvent corresponding to or below the maximum swell volume of the entire coated film.

As the method of applying water, for example, methods described in JP-A-62-253159, page (5), and JP-A-63-85544 are preferably used. Further, the solvent may be enclosed in microcapsules or may take the form of a hydrate, to be previously built into either or both of the light-sensitive material and dye-fixing element, for use.

The suitable temperature of the water to be applied is generally 30 to 60° C., as described, for example, in JP-A-63-85544, supra.

To accelerate the dye transfer, a system can be adopted wherein a hydrophilic heat solvent that is solid at room temperatures and melts at a higher temperature is built in the light-sensitive material and/or the dye-fixing element. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto.

Examples of the hydrophilic heat solvent include ureas, pyridines, amides, sulfonamides, imides, alcohols, oximes, and other heterocyclic compounds.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

As a method wherein the light-sensitive material and the dye-fixing element are placed one upon the other, methods described in JP-A-62-253159 and JP-A-61-147244, on page (27), can be applied.

To process the photographic element of the present invention, any of various development apparatuses can be used, as required. For example, apparatuses described, for example, in JP-A-59-75247, JP-A-59-177547, JP-A-59-181353, and JP-A-60-18951, JU-A-62-25944 ("JU-A" means unexamined published Japanese utility model application), JP-A-6-130509, JP-A-6-95338, JP-A-6-95267, JP-A-8-29955, and JP-A-8-29954 can be preferably used. As a commercially available apparatus, for example, PICTROSTAT 100, PICTROSTAT 200, PICTROSTAT 300, PICTROSTAT 330, PICTROGRAPHY 3000, and PICTROGRAPHY 4000 (all trade names, manufactured by Fuji Photo Film Co., Ltd.), can be used.

According to the dye-fixing element of the present invention, in an image-forming method wherein an image-forming dye or a precursor thereof is produced or released by using a photosensitive silver halide and the resultant dye is diffused or transferred to form an image, a color image excellent in fastness to light can be formed without causing any color-mixing. Therefore, according to the present invention, a method for forming an image excellent in fastness to light without causing any color-mixing can be realized.

Now, the present invention is described in more detail with reference to the following examples, but the present invention is not limited thereto.

EXAMPLE

Example 1

Below is an explanation on how the dye-fixing element is prepared. A sample Dye-Fixing Element 100 was prepared by coating the surface of the support as shown in Table 1 to provide the layer-construction as shown in Table 2.

TABLE 1

Constitution of Support

| Name of layer | Composition | Film thickness (μm) |
|---|---|---|
| Surface undercoat layer | Gelatin | 0.1 |
| Surface PE layer (Glossy) | Low-density polyethylene (Density 0.923) :90.2 parts Surface-processed titanium oxide :9.8 parts Ultramarine :0.001 parts | 36.0 |
| Pulp layer | Fine quality paper (LBKP/NBSP = 6/4 · Density 1.053) | 152.0 |
| Back-surface PE layer (Matte) | High-density polyethylene (Density 0.955) | 27.0 |
| Back-surface undercoat layer | Styrene/acrylate copolymer Colloidal silica Polystyrenesulfonic acid sodium salt | 0.1 |
| | | 215.2 |

TABLE 2

Constitution of Dye-Fixing Element 100

| Number of layer | Additive | Coated amount (mg/m$^2$) |
|---|---|---|
| Sixth layer | Water-soluble polymer(1) | 130 |
| | Water-soluble polymer(2) | 35 |
| | Water-soluble polymer(3) | 45 |

TABLE 2-continued

Constitution of Dye-Fixing Element 100

| Number of layer | Additive | Coated amount (mg/m$^2$) |
|---|---|---|
| | Potassium nitrate | 20 |
| | Anionic surfactant(1) | 6 |
| | Anionic surfactant(2) | 6 |
| | Amphoteric surfactant(1) | 50 |
| | Stain-preventing agent(1) | 7 |
| | Stain-preventing agent(2) | 12 |
| | Matting agent(1) | 7 |
| Fifth layer | Gelatin | 250 |
| | Water-soluble polymer(1) | 25 |
| | Anionic surfactant(3) | 9 |
| | Hardener(1) | 185 |
| Forth layer | Mordant(1) | 1728 |
| | Water-soluble polymer(2) | 260 |
| | Water-soluble polymer(4) | 1400 |
| | Dispersion of latex(1) | 600 |
| | Anionic surfactant(3) | 25 |
| | Nonionic surfactant(1) | 18 |
| | Guanidine picolinate | 2550 |
| | Sodium quinolinate | 350 |
| Third layer | Gelatin | 370 |
| | Mordant(1) | 300 |
| | Anionic surfactant(3) | 12 |
| Second layer | Gelatin | 700 |
| | Mordant(1) | 290 |
| | Water-soluble polymer(1) | 55 |
| | Water-soluble polymer(2) | 330 |
| | Anionic surfactant(3) | 30 |
| | Anionic surfactant(4) | 7 |
| | High-boiling organic solvent(1) | 700 |
| | Brightening agent(1) | 30 |
| | Guanidine picolinate | 360 |
| | Potassium quinolinate | 45 |
| First layer | Gelatin | 190 |
| | Water-soluble polymer(1) | 8 |
| | Anionic surfactant(1) | 10 |
| | Sodium metaborate | 23 |
| | Hardener(1) | 185 |
| Base | Paper Support of Table 3 (thickness 215μm) | |

The coated amount of dispersion of latex is in terms of the coated amount of solid content of latex.

B-1

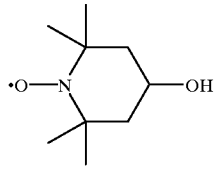

B-2

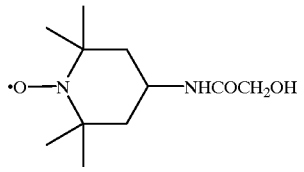

B-3

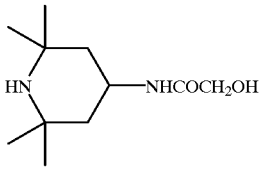

-continued

Anionic surfactant (1)

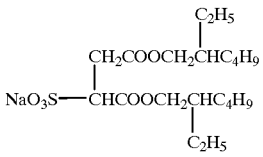

Anionic surfactant (2)

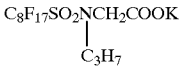

Anionic surfactant (3)

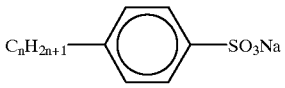

n ≒ 12.6

Anionic surfactant (4)

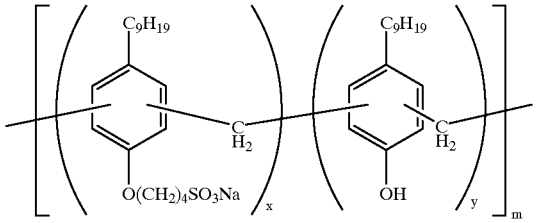

x:y = 4:6
m ≒ 6.8

Nonionic surfactant (1)

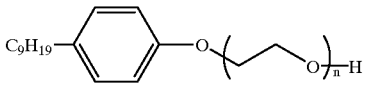

n = 85

Amphoteric surfactant (1)

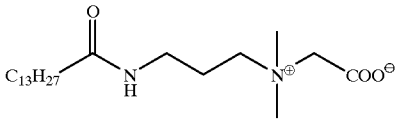

Brightening agent (1)

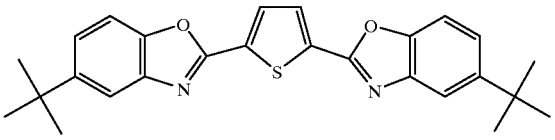

Mordant (1)

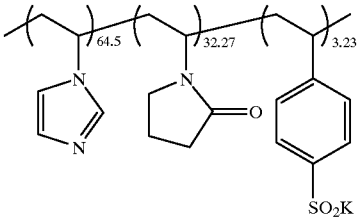

Stain-preventing agent (1)

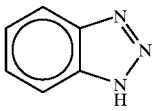

-continued

Stain-preventing agent (2)

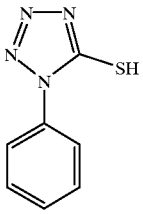

High-boiling oraganic solvent (1)

$C_{28}H_{48.9}Cl_{7.1}$ EMPARA 40 (trade name: manufactured by Ajinomoto K.K.)

Water-soluble polymer (1)

Sumikagel L5-H (trade name: manufactured by Sumitomo Kagaku CO.)

Water-soluble polymer (2)

Dextran (molecular weight 70,000)

Water-soluble polymer (3)

κ (kappa)-Carrageenan (trade name: manufactured by Taito Co.)

Water-soluble polymer (4)

MP polymer MP-102 (trade name: manufactured by Kuraray Co.)

Matting agent (1)

SYLYSIA 431 (trade name: manufactured by Fuji Sylysia Kagaku Co.)

Hardener (1)

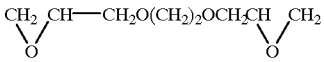

Dispersion of latex (1)

LX-438 (trade name: manufactured by Nippon Zeon Co.)

To the fourth layer of this dye-fixing element was added each of the fade-preventing agents B-1 to B-3 shown in Table 3 in an amount as shown in Table 3 to prepare Dye-Fixing Elements 101–104. Further, Dye-Fixing Elements 105–110 were prepared by adding the mordants shown in Table 3 in the same amount in terms of the imidazole in place of the Mordant (1) added to the fourth layer of the above dye-fixing elements.

TABLE 3

Kind and Amount to Be Added of Fade-Preventing Agent/Mordant in Dye-Fixing Element

| Dye-fixing element | | Fade-preventing agent | Mordant | Composition a/b/c/d/e mol % | Added amount of fade-preventing agent mmol/m$^2$ |
|---|---|---|---|---|---|
| 100 | Comparative example | none | Mordant(1) | — | — |
| 101 | Comparative example | B-1 | Mordant(1) | — | 0.4 |
| 102 | Comparative example | B-2 | Mordant(1) | — | 0.4 |
| 103 | Comparative example | B-3 | Mordant(1) | — | 0.4 |
| 104 | Comparative example | B-3 | Mordant(1) | — | 10 |
| 105 | This invention | Combine with mordant* | Formula(c)** | 62.1/2.4/32.23/3.23/0 | 0.4 |
| 106 | This invention | Combine with mordant* | Formula(c)** | 64.5/0/32.26/0.83/2.4 | 0.4 |
| 107 | This invention | Combine with mordant* | Formula(c)** | 62.3/2.2/32.26/3.03/0.24 | 0.4 |
| 108 | This invention | Combine with mordant* | Formula(c)** | 59.7/4.8/32.26/3.23/0 | 0.8 |
| 109 | This invention | Combine with mordant* | Formula(c)** | 63.3/1.2/32.26/3.23/0 | 0.2 |
| 110 | This invention | Combine with mordant* | Formula(c)** | 63.5/1.0/32.26/3.03/0.2 | 0.2 |

*B-2 was combined in the formula (c).
**In the formula (c), $R_{12}$ and $R_{22}$ each represented a hydrogen atom, $Y_1$ and $Y_2$ each represented a ←CONH group, X represented Cl, M represented K.

The Dye-fixing element 100 is an image-forming material of Comparative Example free from the fade-preventing agent. The Dye-fixing elements 101–104 are image-forming materials of Comparative Examples containing Water-soluble fade-preventing agents B-1 to B-3 in addition to the Mordant (1). The Dye-fixing elements 105–110 are dye-fixing elements of the present invention containing the mordant for use in the present invention wherein the mordant is chemically bound with a stable radical.

Next, the method of preparing a heat-developable color light-sensitive material is explained.

First, the method of preparing a light-sensitive silver halide emulsion is explained.

Light-Sensitive Silver Halide (1) [Emulsion for Fifth Layer (680-nm light-sensitive layer)]

To a well-stirred aqueous solution having the composition shown in Table 4, were added Solutions (I) and (II) each having the composition shown in Table 5, simultaneously over 13 min, and after 10 min, Solutions (III) and (IV) each having the composition shown in Table 5 were added over 33 min.

TABLE 4

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 16 ml |
| Temperature | 45° C. |

TABLE 5

Silver halide solvent (1)

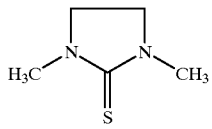

| Component | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.039 mg |
| Total volume | water to make 126 ml | water to make 132 ml | water to make 254 ml | water to make 252 ml |

After 13 min of the start of the addition of Solution (III), 150 ml of an aqueous solution containing 0.350% of Sensitizing Dye (1) was added over 27 min.

Sensitizing dye (1)

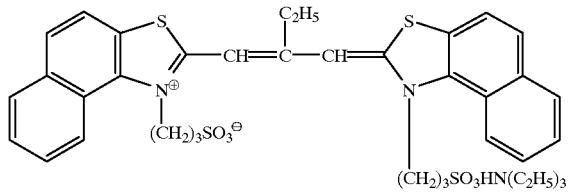

After washing with water and desalting (that was carried out using Settling Agent a, at a pH of 4.1) in a usual manner, 22 g of lime-processed ossein gelatin was added, and after adjusting the pH and pAg to 6.0 and 7.9 respectively, the chemical sensitization was carried out at 60° C. The compounds used in the chemical sensitization are shown in Table 6. The yield of the obtained emulsion was 630 g and the emulsion was a monodisperse cubic silver chlorobromide emulsion having a deviation coefficient of 10.2% and an average grain size of 0.20 μm.

TABLE 6

Precipitating agent a.

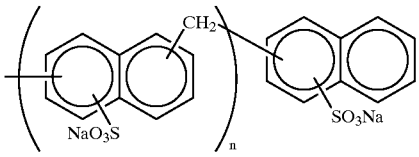

Precipitating agent b.

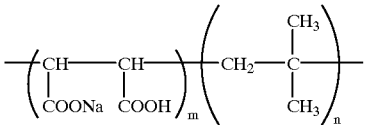

| Chemicals used in chemical sensitization | Added amount |
|---|---|
| 4-hydroxy-6-methyl-1,3,3a,7-tetrazaindene | 0.36 g |
| Sodium thiosulfate | 6.75 mg |
| Antifoggant① | 0.11 g |
| Antiseptic① | 0.07 g |
| Antiseptic② | 3.13 g |

Antifoggant ①

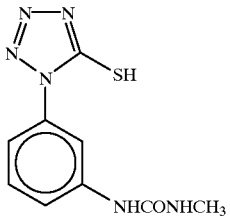

Antiseptic ①

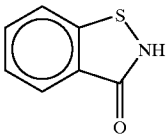

Antiseptic ②

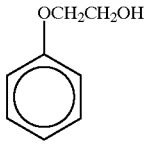

Light-Sensitive Silver Halide Emulsion (2) [Emulsion for Third Layer (750-nm light-sensitive layer)]

To a well-stirred aqueous solution having the composition shown in Table 7, were added Solutions (I) and (II) each having the composition shown in Table 8, simultaneously over 18 min, and after 10 min, Solutions (III) and (IV) each having the composition shown in Table 8 were added over 24 min.

TABLE 7

| Composition | |
|---|---|
| $H_2O$ | 620 ml |
| Lime-processed gelatin | 20 g |
| KBr | 0.3 g |
| NaCl | 2 g |
| Silver halide solvent① | 0.030 g |
| Sulfuric acid (1N) | 16 ml |
| Temperature | 45° C. |

TABLE 8

| Component | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_4[Fe(CN)_6]\cdot H_2O$ | — | — | — | 0.065 g |
| $K_2IrCl_6$ | — | — | — | 0.040 mg |
| Total volume | water to make 188 ml | water to make 188 ml | water to make 250 ml | water to make 250 ml |

After washing with water and desalting (that was carried out using the above Settling Agent b at a pH of 3.9) in a usual manner, 22 g of lime-processed ossein gelatin from which calcium had been removed (the calcium content: 150 ppm or less) was added, re-dispersing was made at 40° C., 0.39 g of 4-hydroxy-6-methyl-1,3,3a,-7-tetrazaindene was added, and the pH and pAg were adjusted to 5.9 and 7.8 respectively. Thereafter the chemical sensitization was carried out at 70° C. Compounds used the chemical sensitization are shown in Table 9. At the end of the chemical sensitization, Sensitizing Dye ② in the form of a methanol solution (the solution having the composition shown in Table 10) was added. After the chemical sensitization, the temperature was lowered to 40° C. and then 200 g of a gelatin dispersion of the later-described Stabilizer ① was added, followed by stirring well and keeping in a case. The yield of the thus-obtained emulsion was 938 g, and the emulsion was a monodisperse cubic silver chlorobromide emulsion having a deviation coefficient of 12.6% and an average grain size of 0.25 μm.

TABLE 9

| Chemicals used in chemical sensitization | Added amount |
|---|---|
| 4-hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant② | 0.10 g |
| Antiseptic① | 0.07 g |

TABLE 10

| Composition of dye solution | Added amount |
|---|---|
| Sensitizing dye② | 0.19 g |
| Methanol | 18.7 ml |

Stabilizer ①

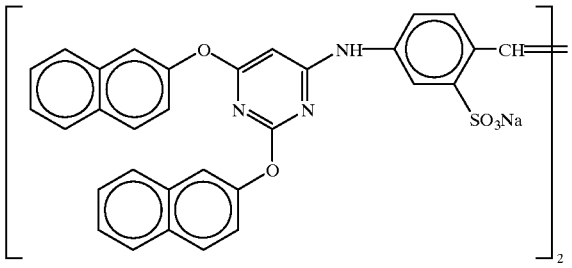

Antifoggant ②

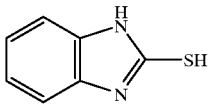

Sensitizing dye ②

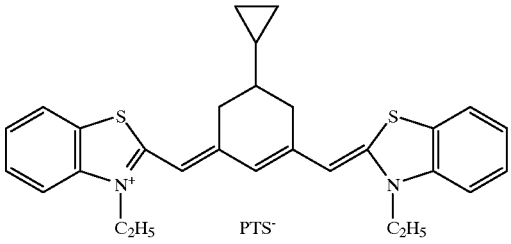

PTS:Paratoluenesulfonic acid

Light-Sensitive Silver Halide Emulsion (3) [Emulsion for First Layer (810-nm light-sensitive layer)]

To a well-stirred aqueous solution having the composition shown in Table 11, were added Solutions (I) and (II) each having the composition shown in Table 12, simultaneously over 18 min, and after 10 min, Solutions (III) and (IV) each having the composition shown in Table 12 were added over 24 min.

TABLE 11

| Composition | |
|---|---|
| $H_2O$ | 620 ml |
| Lime-processed gelatin | 20 g |
| KBr | 0.3 g |
| NaCl | 2 g |
| Silver halide solvent① | 0.030 g |
| Sulfuric acid (1N) | 16 ml |
| Temperature | 50° C. |

TABLE 12

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total volume | water to make 180 ml | water to make 181 ml | water to make 242 ml | water to make 250 ml |

After washing with water and desalting (that was carried out using Settling Agent a at a pH of 3.8) in a usual manner, 22 g of lime-processed ossein gelatin was added, and after adjusting the pH and pAg to 7.4 and 7.8 respectively, the chemical sensitization was carried out at 60° C. The compounds used in the chemical sensitization are shown in Table 13. The yield of the thus-obtained emulsion was 683 g, and the emulsion was a monodisperse cubic silver chlorobromide emulsion having a deviation coefficient of 9.7% and an average grain size of 0.32 μm.

TABLE 13

| Chemicals used in chemical sensitization | Added amount |
|---|---|
| 4-hydroxy-6-methyl-1,3,3a,7-tetrazaindene | 0.38 g |
| Triethylthiourea | 3.10 mg |
| Antifoggant② | 0.19 g |
| Antiseptic① | 0.07 g |
| Antiseptic② | 3.13 g |

Next, the method of preparing silver chloride grains of fine grains which were added to the First Layer (810-nm light-sensitive layer) is described.

To a well-stirred aqueous solution having the composition shown in Table 14, were added Solutions (I) and (II) each having the composition shown in Table 15, simultaneously over 4 min, and after 3 min, Solutions (III) and (IV) each having the composition shown in Table 15 were added over 8 min.

TABLE 14

| Composition | |
|---|---|
| $H_2O$ | 3770 ml |
| Lime-processed gelatin | 60 g |
| NaCl | 0.8 g |
| 38° C. | |

TABLE 15

| | Solution (I) | Solution (II) | Solution (III) | Solution (IV) |
|---|---|---|---|---|
| $AgNb_3$ | 300 g | | 300 g | |
| $NH_4NO_3$ | 10 g | | 10 g | |
| NaCl | | 108 g | | 104 g |
| Total volume | water to make 940 ml | Water to make 940 ml | water to make 1170 ml | water to make 1080 ml |

After washing with water and then desalting (effected at pH 3.9 using the Precipitating agent a) according to an ordinary method, 132 g of lime-treated gelatin was added and the mixture was again dispersed at 35° C. To the dispersion was added 4 g of 4-hydroxy-6-methyl-1,3,3a,7-tetrazaindene and the pH value was adjusted to 5.7. The yield of the resultant silver chloride fine grain emulsion was 3200 g having an average grain size of 0.10 μm.

Next, the preparation method of a gelatin dispersion of colloidal silver is described.

To a well-stirred aqueous solution having the composition shown in Table 16, was added a Solution having the composition shown in Table 17, over 24 min. Thereafter, the washing with water using Settling Agent a was carried out, then 43 g of lime-processed ossein gelatin was added, and the pH was adjusted to 6.3. The average grain size of the thus-obtained grains in the dispersion was 0.02 μm and the yield was 512 g. (The dispersion was a dispersion containing silver 2% and gelatin 6.8%.)

TABLE 16

| Composition | |
|---|---|
| $H_2O$ | 620 ml |
| Dextrin | 16 g |
| NaOH (5N) | 41 ml |
| Temperature | 30° C. |

TABLE 17

| Composition | |
|---|---|
| $H_2O$ | 135 ml |
| $AgNO_3$ | 17 g |

Next, the preparation methods of gelatin dispersions of hydrophobic additives are described.

Gelatin dispersions of a yellow dye-providing compound, a magenta dye-providing compound, or a cyan dye-providing compound whose formulation are shown in Table 18, were prepared, respectively. That is, the oil phase components were dissolved by heating to about 70° C., to form a uniform solution, and to the resultant solution, was added the aqueous phase components that had been heated to about 60° C., followed by stirring to mix and dispersing by a homogenizer for 10 min at 10,000 rpm. To the resultant dispersion, was added additional water, followed by stirring, to obtain a uniform dispersion. Further, by using an ultrafiltration module (Ultrafiltration Module ACV-3050, trade name, manufactured by Asahi Chemical Industry Co., Ltd.), the gelatin dispersion of the cyan dye-imparting compound was repeatedly diluted with water and concentrated to decrease the amount of ethyl acetate so that the amount might become 1/17.6 of the amount of ethyl acetate shown in Table 18.

TABLE 18

| | | Composition of dispersion | | | | | | |
|---|---|---|---|---|---|---|---|---|
| | | Yellow① | Yellow② | Yellow③ | Magenta ②Magenta ② | Cyan① | Cyan② | |
| Oil phase | Cyan dye-providing compound① | — | — | — | — | — | 2.6 | — |
| | Cyan dye-providing compound② | — | — | — | — | — | 1.78 | — |
| | Cyan dye-providing compound③ | — | — | — | — | — | — | 4.45 |
| | Magenta dye-providing compound① | — | — | — | 3.82 | — | — | — |
| | Magenta dye-providing compound② | — | — | — | — | 5.27 | — | — |
| | Yellow dye-providing compound① | 5.83 | — | 1.68 | — | — | — | — |
| | Yellow dye-providing compound② | — | 4.66 | 4.03 | — | — | — | — |
| | Reducing agent① | 0.41 | 0.41 | 0.47 | 0.05 | 0.06 | 0.24 | 0.29 |
| | Antifoggant③ | 0.05 | 0.07 | 0.1 | — | — | 0.04 | 0.06 |
| | Antifoggant④ | — | — | — | 0.13 | 0.21 | — | — |
| | Surfactant① | 0.5 | 0.5 | 0.6 | — | 0.23 | — | 0.45 |
| | High-boiling solvent① | 2.92 | — | 0.84 | — | — | 1.13 | 1.34 |
| | High-boiling solvent② | — | 2.33 | 2.01 | 1.91 | 2.63 | 1.21 | 4.47 |
| | High-boiling solvent③ | — | — | — | — | — | 0.3 | — |
| | Development accelerator① | — | 1.17 | 1.01 | — | — | — | — |
| | Dye(a) | 0.51 | 0.59 | 0.59 | — | — | 0.12 | 0.14 |
| | Water | 0.19 | 0.17 | 0.19 | — | — | — | 0.3 |
| | Ethyl acetate | 5 | 8 | 10 | 13 | 16 | 13 | 16 |
| Aqueous phase | Lime-processed gelatin | 4.7 | 4.7 | 5.5 | 2.3 | 3.1 | 2.4 | 2.4 |
| | Calcium nitrate | 0.05 | 0.05 | 0.05 | 0.03 | 0.04 | — | — |
| | Surfactant① | — | — | — | 0.05 | — | 0.2 | — |
| | Sodium hydroxide aq.soln.(1N) | — | — | — | 0.5 | — | 0.06 | 0.07 |
| | Carboxymethyl cellulose | — | — | — | — | — | 27 | 31 |
| | Water | 3.3 | 3.3 | 35 | 28 | 31 | 51 | 40 |
| | Water(after emulsification) | 47 | 51 | 40 | 40 | 43 | 0.03 | 0.03 |
| | Antiseptic① | 0.002 | 0.002 | 0.003 | 0.002 | 0.002 | | |

A gelatin dispersion of Antifoggant ④ whose formulation is shown in Table 19 was prepared. That is, the oil phase components were dissolved by heating to about 60° C., to the resultant solution, was added the aqueous phase components that had been heated to about 60° C, and after stirring and mixing them, the resultant mixture was dispersed for 10 min at 10,000 rpm by a homogenizer, to obtain a uniform dispersion.

TABLE 19

| | | Composition of dispersion |
|---|---|---|
| Oil phase | Antifoggant④ | 0.8 g |
| | Reducing agent① | 0.1 g |
| | High-boiling solvent② | 2.3 g |
| | High-boiling solvent⑤ | 0.2 g |
| | surfactant① | 0.5 g |
| | Surfactant④ | 0.5 g |
| | Ethyl acetate | 10.0 ml |
| Aqueous phase | Lime-processed gelatin | 10.0 g |
| | Antiseptic① | 0.004 g |
| | Calcium nitrate | 0.1 g |
| | Water | 35.0 ml |
| | Additional water | 46.0 ml |

A gelatin dispersion of High-boiling solvent ② whose formulation is shown in Table 20 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 20

| | | Composition of dispersion |
|---|---|---|
| Oil phase | High-boiling solvent② | 9.1 g |
| | High-boiling solvent⑤ | 0.2 g |
| | Surfactant① | 0.5 g |
| | Surfactant④ | 0.5 g |
| | Ethyl acetate | 10.0 ml |
| Aqueous phase | Acid-processed gelatin | 10.0 g |
| | Antiseptic① | 0.004 g |
| | Calcium nitrate | 0.1 g |
| | Water | 74.0 ml |
| | Additional water | 104.0 ml |

A gelatin dispersion of Reducing Agent ② whose formulation is shown in Table 21 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion. From the thus-obtained dispersion, ethyl acetate was removed off using a vacuum organic solvent removing apparatus.

TABLE 21

| | | Composition of dispersion |
|---|---|---|
| Oil phase | Reducing agent② | 7.5 g |
| | High-boiling solvent① | 4.7 g |
| | Surfactant① | 1.9 g |
| | Ethyl acetate | 14.4 ml |
| Aqueous phase | Acid-processed gelatin | 10.0 g |
| | Antiseptic① | 0.02 g |
| | Antiseptic4 | 0.04 g |
| | Sodium bisulfite | 0.1 g |
| | Water | 136.7 ml |

A dispersion of Polymer Latex a whose formulation is shown in Table 22 was prepared. That is, while a mixed solution of Polymer Latex (a), Surfactant ⑤, and water whose amounts are shown in Table 22 was stirred, Anionic Surfactant ⑥ was added thereto, over 10 min, to obtain a uniform dispersion. The resulting dispersion was repeatedly diluted with water and concentrated using a ultrafiltration module (Ultrafiltration Module: ACV-3050, trade name, manufactured by Ashahi Chemical Industry Co., Ltd.), to bring the salt concentration of the dispersion to 1/9, thereby obtaining a discripsion.

TABLE 22

| | Composition of dispersion |
|---|---|
| Polymer Latex (a) aqueous solution (solid content 13%) | 108 ml |
| Surfactant⑤ | 20 g |
| Surfactant⑥ aqueous solution (5%) | 600.0 ml |
| Water | 1232.0 ml |

A gelatin dispersion of Stabilizer ① whose formulation is shown in Table 23 was prepared. That is, the oil phase components were dissolved at room temperature, to the resultant solution, was added the aqueous phase components that had been heated to about 40° C., and after stirring and mixing them, the resultant mixture was dispersed for 10 min at 10,000 rpm by a homogenizer. To the resultant dispersion, was added additional water, followed by stirring, thereby obtaining a uniform dispersion.

TABLE 23

| | | Composition of dispersion |
|---|---|---|
| Oil phase | Stabilizer① | 4.0 g |
| | Sodium hydroxide | 0.3 g |
| | Methanol | 62.8 g |
| | High-boiling solvent② | 0.9 g |
| Aqueous phase | Gelatin from which calcium had been removed (Ca content 100 ppm or less) | 10.0 g |
| | Antiseptic① | 0.04 g |
| | Water | 320.5 ml |

A gelatin dispersion of zinc hydroxide was prepared according to the formulation shown in Table 24. That is, after the components were mixed and dissolved, dispersing was carried out for 30 min in a mill, using glass beads having an average particle diameter of 0.75 mm. Then the glass beads were separated and removed off, to obtain a uniform dispersion. (The zinc hydroxide having an average particle size of 0.25 $\mu$m was used.)

TABLE 24

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| High-boiling solvent② | 0.4 g |

The preparation method of a gelatin dispersion of a matting agent that was added to the protective layer is described.

A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 $\mu$m.

Cyan dye-providing compound ①
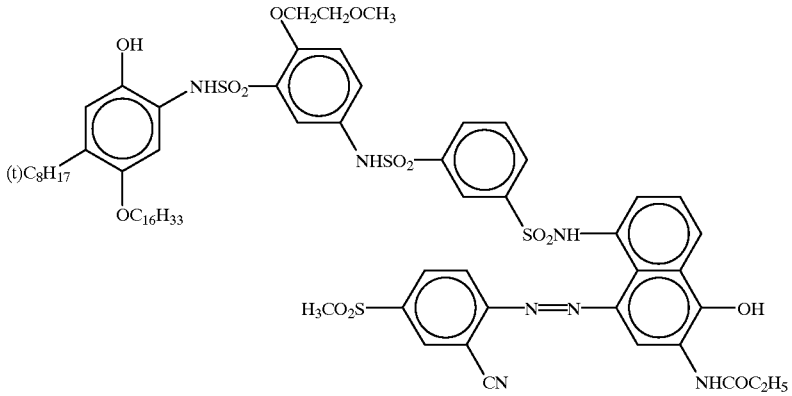
Cyan dye-providing compound ②
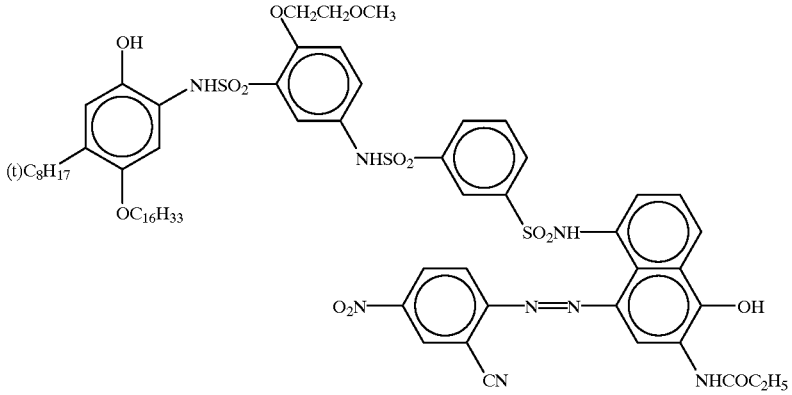
Cyan dye-providing compound ③
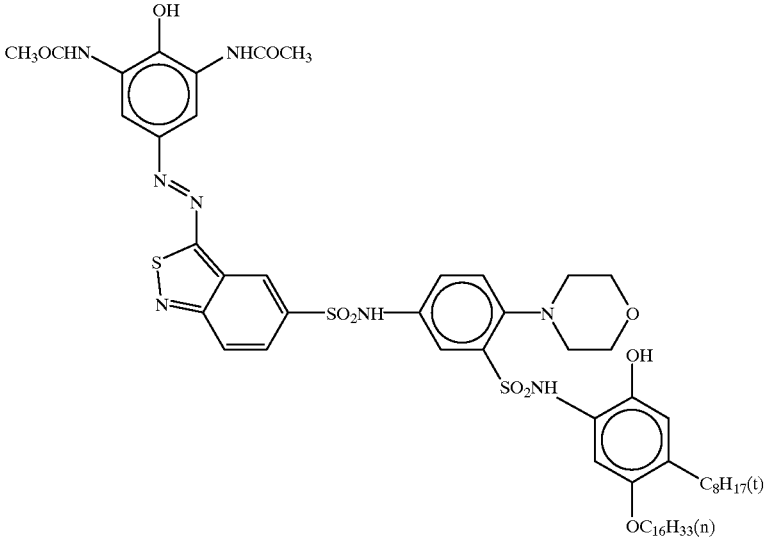

-continued
Dye (a)
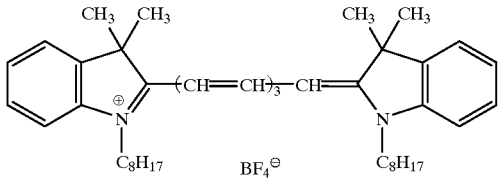
Magenta dye-providing compound ①
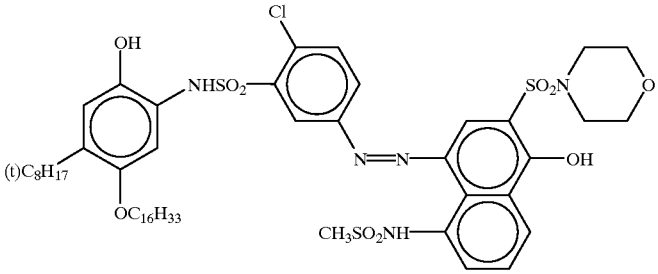
Magenta dye-providing compound ②
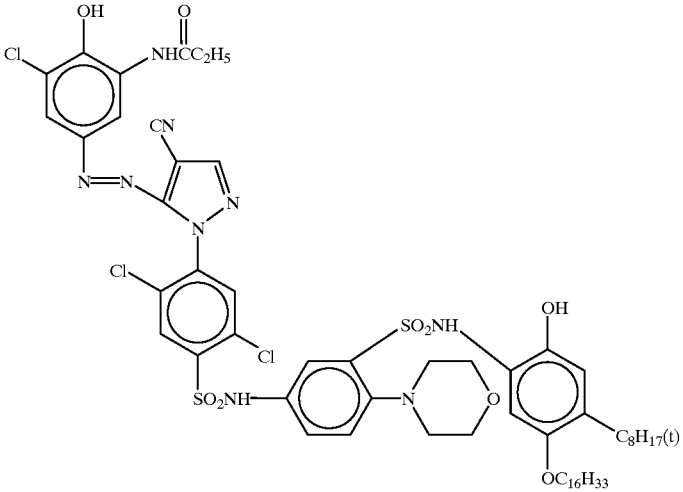
Yellow dye-providing compound ①
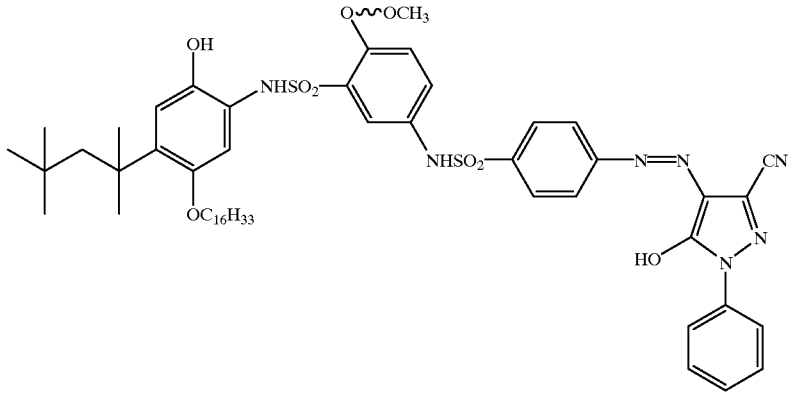

-continued
Yellow dye-providing compound ②
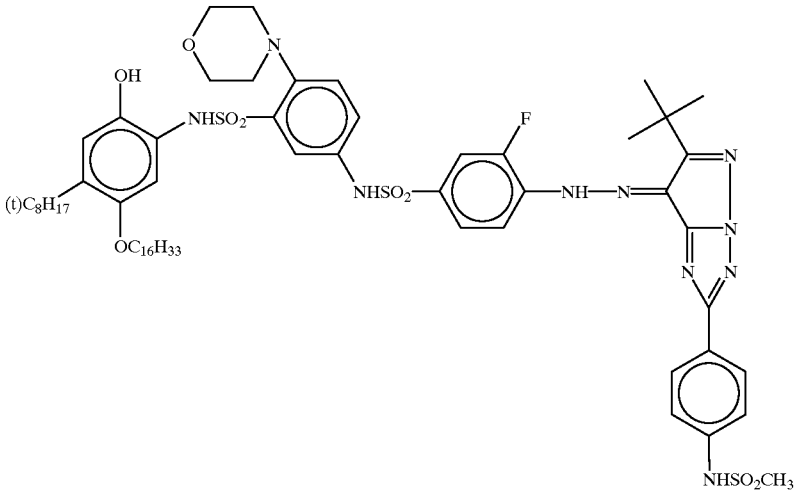
Reducing agent ①
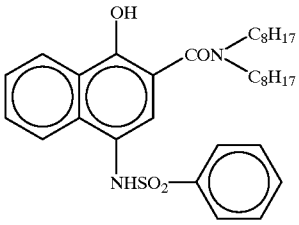
Antifoggant ③
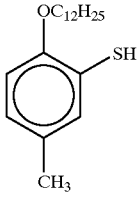
Antifoggant ④
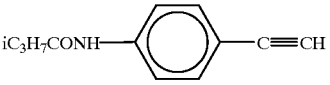
Surfactant ①
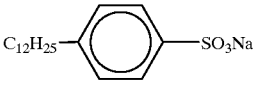
Development accelerator ①
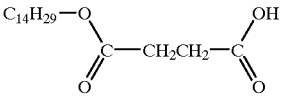
High-boiling solvent ①
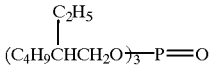
High-boiling solvent ②
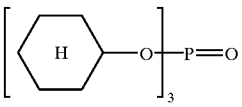
High-boiling solvent ③
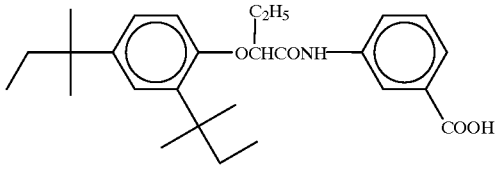
Antiseptic ③
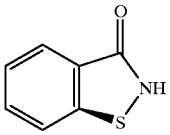
Reducing agent ②
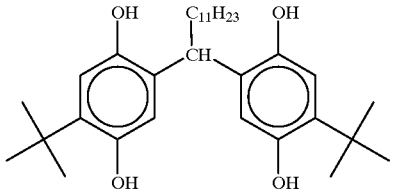

-continued
Antiseptic ④
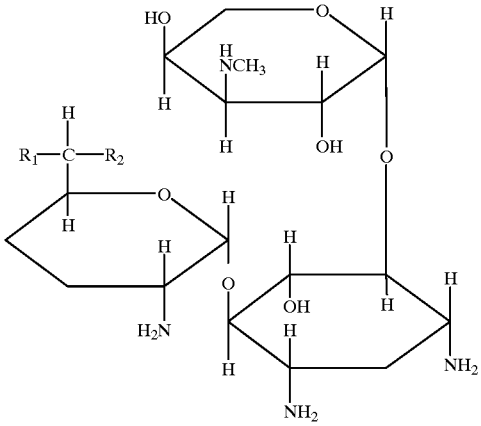
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant ②
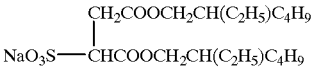
Surfactant ③
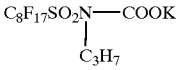
Water-soluble polymer ①
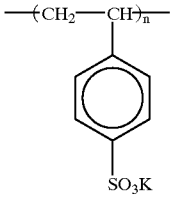
limiting-viscosity [η] = 1.6
(0.1N NaCl, 30° C.)
molecular weight = 1,000,000
Water-soluble polymer ②
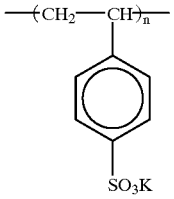
limiting-viscosity [η] = 0.8
(0.1N NaCl, 30° C.)
molecular weight = 400,000
Antifoggant ⑤
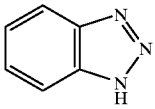
Hardener ①
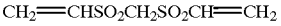
Sensitizing dye ③
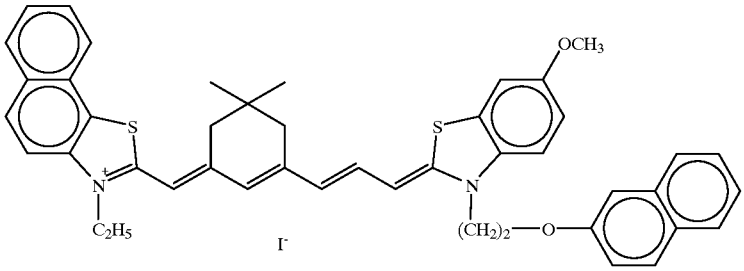
Surfactant ⑦
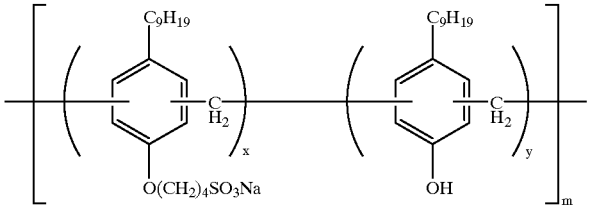
x:y = 4:6
m ⇌ 6.8

-continued

High-boiling organic solvent ⑤

$C_{25}H_{45.9}Cl_{7.1}$

EMPARA 40 (trade name: manufactured by Ajinomoto K.K.)

Polymer Latex a

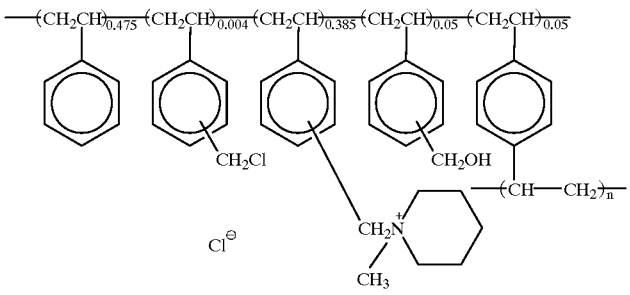

Surfactant ④

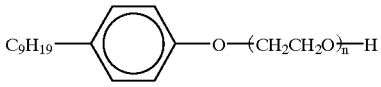

n = 50

Surfactant ⑤

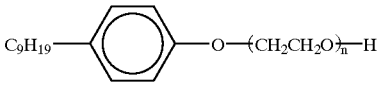

n = 60

Surfactant ⑥

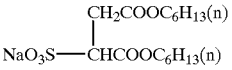

Using the above materials, Heat-Developable Color Light-Sensitive Materials 100 and 101 shown in Table 25 were prepared.

TABLE 25

Constitution of Main Materials of Heat-Developable Light-Sensitive Materials 100 and 101

| Number of layer | Name of layer | Additive | Coating amount(mg/m²) 100 | 101 |
|---|---|---|---|---|
| Seventh layer | Protective layer | Acid-processed gelatin | 374 | 378 |
| | | Reducing agent② | 47 | 70 |
| | | High-boiling solvent① | 30 | 44 |
| | | Collidal silver grains | 2 | 2 |
| | | Matting agent(PMMA resin) | 17 | 17 |
| | | Surfactant① | 13 | 19 |
| | | Surfactant② | 16 | 16 |
| | | Surfactant③ | 2 | 2 |
| | | Surfactant④ | — | 12 |
| | | Surfactant⑥ | — | 17 |
| | | Polymer Latex a | — | 14 |
| | | Calcium nitrate | 5 | 5 |
| Sixth layer | Intermediate layer | Lime-processed gelatin | 735 | 882 |
| | | Zinc hydroxide | 481 | 577 |
| | | Antifoggant④ | — | 18 |
| | | Reducing agent① | — | 2 |
| | | High-boiling solvent② | — | 54 |
| | | High-boiling solvent⑤ | — | 6 |
| | | Surfactant① | — | 11 |
| | | Surfactant② | 0.5 | 0.5 |
| | | Surfactant⑦ | — | 11 |
| | | Water-soluble polymer① | 4 | 5 |
| | | Calcium nitrate | 14 | 17 |

TABLE 25-continued

Constitution of Main Materials of Heat-Developable Light-Sensitive Materials 100 and 101

| Number of layer | Name of layer | Additive | Coating amount(mg/m²) 100 | 101 |
|---|---|---|---|---|
| Fifth layer | 680-nm light-sensitive layer | Lime-processed gelatin | 565 | 428 |
| | | Light-sensitive silver halide emulsion (1) | 302 | 287 |
| | | Magenta dye-providing compound① | 420 | — |
| | | Magenta dye-providing compound② | — | 487 |
| | | High-boiling solvent② | 211 | 244 |
| | | Reducing agent① | 6 | 6 |
| | | Antifoggant④ | 19 | 20 |
| | | Surfactant① | 6 | 22 |
| | | Water-soluble polymer① | 8 | 11 |
| Forth layer | Intermediate layer | Lime-processed gelatin | 413 | 416 |
| | | Zinc hydroxide | 270 | 271 |
| | | Antifoggant④ | — | 8 |
| | | Reducing agent① | — | 1 |
| | | High-boiling solvent② | — | 25 |
| | | High-boiling solvent⑤ | — | 3 |
| | | Surfactant① | — | 5 |
| | | Surfactant② | 0.3 | 0.3 |
| | | Surfactant⑦ | — | 5 |
| | | Water-soluble polymer① | 2 | 2 |
| | | Calcium nitrate | 8 | 8 |
| Third layer | 750-nm light-sensitive layer | Lime-processed gelatin | 375 | 404 |
| | | Light-sensitive silver halide emulsion(2) | 106 | 184 |
| | | Stabilizer① | 7 | 8 |
| | | Cyan dye-providing compound | 159 | — |

TABLE 25-continued

Constitution of Main Materials of Heat-Developable Light-Sensitive Materials 100 and 101

| Number of layer | Name of layer | Additive | Coating amount(mg/m²) 100 | 101 |
|---|---|---|---|---|
| | | ① Cyan dye-providing compound | 233 | — |
| | | ② Cyan dye-providing compound | — | 428 |
| | | ③ Dye(a) | 10 | 13 |
| | | High-boiling solvent① | 101 | 128 |
| | | High-boiling solvent② | 108 | 429 |
| | | High-boiling solvent③ | 27 | — |
| | | Reducing agent① | 22 | 28 |
| | | Antifoggant③ | 5 | 5 |
| | | Surfactant① | 12 | 43 |
| | | Carboxymethyl cellulose | 5 | 7 |
| | | Water-soluble polymer① | 10 | 9 |
| Second layer | Intermediate layer | Lime-processed gelatin | 440 | 708 |
| | | Antifoggant⑤ | 6 | 4 |
| | | Surfactant② | 4 | 2 |
| | | Surfactant⑤ | 163 | 104 |
| | | Water-soluble polymer② | 5 | 14 |
| | | Calcium nitrate | 8 | 5 |
| First layer | 810-nm light-sensitive layer | Lime-processed gelatin | 583 | 569 |
| | | Light-sensitive silver halide emulsion(3) | 309 | 330 |
| | | Fine grain silver chloride | — | 30 |
| | | Stabilizer① | 8 | 8 |
| | | Yellow dye-providing compound① | 481 | 119 |
| | | Yellow dye-providing compound② | — | 285 |
| | | Sensitizing dye③ | 0.1 | 0.1 |
| | | Dye(a) | 44 | 42 |
| | | High-boiling solvent① | 250 | 59 |
| | | High-boiling solvent② | — | 143 |
| | | Surfactant① | 44 | 41 |
| | | Reducing agent① | 39 | 33 |
| | | Development accelerator① | — | 71 |
| | | Antifoggant③ | 4 | 6 |
| | | Water-soluble polymer② | 42 | 41 |
| | | Hardener① | 45 | 45 |

Base (Paper support whose both surfaces had been laminated with polyethylene:thickness 135 μm)
(Note)
Sensitizing dyes, antifoggants, etc., added with light-sensitive silver halide emulsions are omitted from description. Additives used in microamounts, such as antiseptics, etc., are also omitted from description.

The photosensitive material 100 is different from the photosensitive material 101 in the sort of dye-imparting compound. In the photosensitive material 101, the magenta dye-imparting compound is changed from ① to ②, the cyan dye-imparting compound is changed from ①+② to ③, and the yellow dye-imparting compound is changed from ① to ①+②, respectively to the light-sensitive material 100.

Evaluation of Fastness to Light

The above dye-fixing elements 100–110 were combined respectively with the above photosensitive material 100 or 101 and subjected to exposure followed by thermal development with the aid of a printer marketed from Fuji Photo Film Co., Ltd. under the trade name of PICTROGRAPHY 3000 thereby obtaining images wherein the densities of monochromes and gray were changed stepwise.

A photofading test of these samples was carried out under the following conditions:

Fade-O-meter: Weather-O meter 65WRC (trade name, manufactured by ATLAS)

Brightness cycle: light (100,000 Lux)/dark=3.8 hr/1 hr

Filter: Fuji Filter SC37

Reflex densities of cyan in black solid portion of the dye-fixing element before the fading test and 2 weeks after the fading test were respectively measured by the aid of X-rite 310TR, trade name, manufactured by X-rite Co., to obtain the remaining ratio of the dye after the fading test. The values measured are shown in Table 26. The improving effect in fastness to light was most significant for cyan in black portion, but the improving effect was recognized not only in black portion but also in a low density portion as well as in cyan tint alone.

Evaluation of Color-mixing

The above dye-fixing elements 100–110 were combined respectively with the above photosensitive material 100 or 101 and subjected to exposure followed by thermal development with the aid of a printer marketed from Fuji Photo Film Co., Ltd. under the trade name of PICTROGRAPHY 3000, to obtain a portrait image including patches wherein individual monochromes of cyan, magenta and yellow were stepwise changed in density.

On evaluation of the portrait image including the monochrome patches, there was found a sample wherein magenta and yellow were mixed up in cyan monochrome portion to reduce the maximum density of cyan. The densities of cyan and magenta in portion giving the maximum cyan monochrome density were measured with the aid of X-rite 310TR, trade name, manufactured by X-rite Co., to evaluate this phenomenon. The values measured are shown in Table 26. A similar phenomenon of color-mixing was observed in not only magenta in cyan monochrome but also yellow in cyan, cyan and yellow in magenta, and cyan and magenta in yellow. A similar phenomenon was also observed in a portion where the density was low.

TABLE 26

Result of evaluation of fastness to light and color-mixing of an image obtained by combination with color-fixing element/light-sensitive material

| Color-fixing element | Light-sensitive material | Remarks | Remaining ratio of dye (%) | Cyan density | Magenta density in cyan |
|---|---|---|---|---|---|
| 100 | 100 | Comparative example | 60 | 2.23 | 0.63 |
| 101 | 100 | Comparative example | 72 | 2.13 | 1.56 |
| 102 | 100 | Comparative example | 69 | 2.11 | 1.35 |
| 103 | 100 | Comparative example | 63 | 2.25 | 0.64 |
| 104 | 100 | Comparative example | 70 | 2.22 | 0.69 |
| 105 | 100 | This invention | 72 | 2.25 | 0.69 |
| 106 | 100 | This invention | 72 | 2.20 | 0.62 |
| 107 | 100 | This invention | 70 | 2.25 | 0.62 |
| 108 | 100 | This invention | 78 | 2.28 | 0.64 |

TABLE 26-continued

Result of evaluation of fastness to light and color-mixing of an image obtained by combination with color-fixing element/light-sensitive material

| Color-fixing element | Light-sensitive material | Remarks | Remaining ratio of dye (%) | Cyan density | Magenta density in cyan |
|---|---|---|---|---|---|
| 109 | 100 | This invention | 67 | 2.23 | 0.61 |
| 110 | 100 | This invention | 67 | 2.24 | 0.51 |
| 100 | 101 | Comparative example | 72 | 2.35 | 0.55 |
| 101 | 101 | Comparative example | 88 | 2.13 | 1.53 |
| 102 | 101 | Comparative example | 89 | 2.09 | 1.65 |
| 103 | 101 | Comparative example | 78 | 2.33 | 0.66 |
| 104 | 101 | Comparative example | 80 | 2.25 | 0.63 |
| 105 | 101 | This invention | 88 | 2.35 | 0.59 |
| 106 | 101 | This invention | 87 | 2.33 | 0.55 |
| 107 | 101 | This invention | 89 | 2.32 | 0.57 |
| 108 | 101 | This invention | 93 | 2.38 | 0.53 |
| 109 | 101 | This invention | 85 | 2.35 | 0.54 |
| 110 | 101 | This invention | 85 | 2.34 | 0.55 |

In view of the foregoing results, it is recognized that when the dye-fixing elements 105–110 of the present invention were used, it brought about a higher remaining ratio of cyan and extremely low magenta color-mixing in the cyan, as compared to using the dye-fixing elements 100 to 103 for comparison. This tendency was commonly seen in the photosensitive materials 100 and 101.

With respect to the dye-fixing element 104 for comparison, on the other hand, the remaining ratio of cyan was not so low and magenta color-mixing in the cyan was relatively low. This is perhaps ascribable to the reason that the amount of the fade-preventing agent B-3 to be added was 25 times as much as the amount in the dye-fixing element 103. However, addition of such a large amount of the fade-preventing agent incurs a drawback that the film quality of the dye-fixing element is considerably deteriorated (mechanical strength is weakened). In contrast to this, such problem is not caused by the dye-fixing element of the present invention, and moreover, fastness of an image to light can be improved without causing any color-mixing.

The above test was carried out to an image obtained in the same manner in the above, except for using PICTROSTAT DONOR FILM PS-DS (trade name, marketed from Fuji Photo Film Co., Ltd.) in place of the photosensitive material used in the above and using a printer marketed from Fuji Photo Film Co., Ltd. under the trade name of PICTROSTAT 330 in place of the printer used in the above. As a result, it was found that the dye-fixing elements 105–110 of the present invention using the mordant to which a stable radical had been bound chemically according to the invention could improve fastness to light without causing color-mixing even in a smaller amount to be added, as compared with the cases wherein a radical or a radical precursor (fade-preventing agent) was singly added.

Having described our invention as related to the present embodiments, it is our intention that the invention not be limited by any of the details of the description, unless otherwise specified, but rather be construed broadly within its spirit and scope as set out in the accompanying claims.

What we claim is:

1. A dye-fixing element utilizable to form an image by releasing or producing an image-forming dye or a precursor thereof in proportion or contraproportion to developed silver formed by development after imagewise exposing of a photosensitive silver halide and thereafter by diffusion or diffusive-transfer of the dye, which element comprises a polymeric dye mordant containing a recurring unit represented by the following formula (A) and/or a recurring unit represented by the following formula (B):

formula (A)

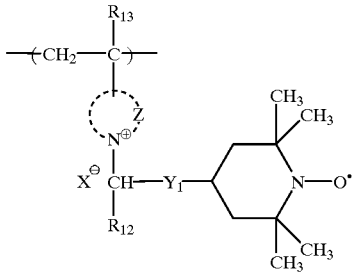

formula (B)

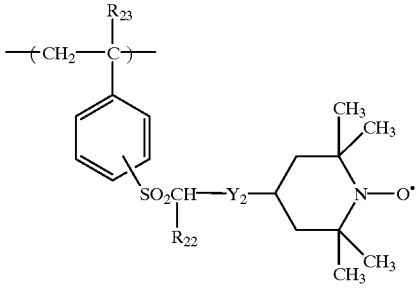

wherein $R_{12}$ and $R_{22}$ each stand for a hydrogen atom or an alkyl group, $Y_1$ and $Y_2$ each stand for ←CONR$_4$—, ←COO— or ←CH(OH)CH$_2$O—, X stands for a chlorine atom, a bromine atom, an iodine atom or a hydroxyl group, Z stands for an atomic group necessary for forming a 5- to 7-membered hetero ring together with the nitrogen atom, $R_{13}$ and $R_{23}$ each stand for a hydrogen atom, a methyl group, an ethyl group, or a halogen atom, and $R_4$stands for a hydrogen atom or an alkyl group having 1 to 4 carbon atoms, and wherein ← stands for a bond on the side of a main chain of the polymer.

2. The dye-fixing element according to claim 1, wherein a photosensitive material and/or the dye-fixing element is incorporated with a base or a precursor thereof and the material and the element are overlapped each other with a small amount of water and heated after imagewise exposure, thereby effecting the development.

3. The dye-fixing element according to claim 1, wherein the dye-mordant contains the recurring unit represented by the formula (A) and/or the recurring unit represented by the formula (B) in an amount of at least 0.5 mol % based on the total recurring unit being 100 mol %.

4. The dye-fixing element according to claim 1, wherein the dye-mordant is represented by the following formula (C):

formula (C)

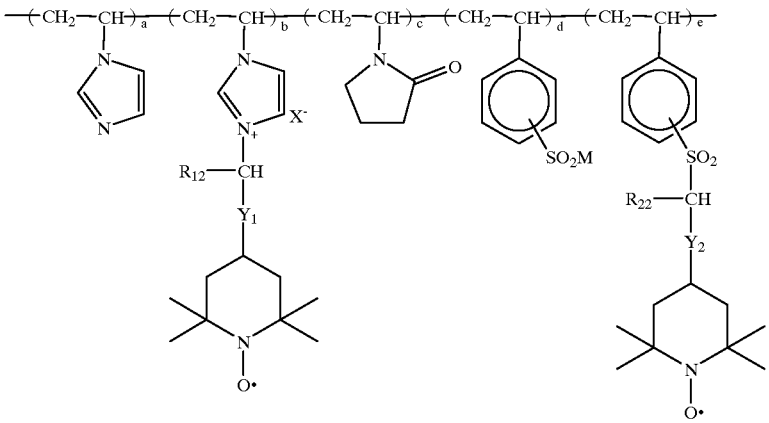

wherein $Y_1$, $Y_2$, $R_{12}$, $R_{22}$ and X have the same meanings as defined in the formulas (A) and (B), M stands for an alkali metal ion, a is 50–99 mol %, a total of b and e is 1–10 mol %, c is 0–49 mol %, and d is 0–10 mol %, with the proviso that a, b, c, d, and e are so selected that the total becomes 100 mol %.

5. The dye-fixing element according to claim 1, wherein, in the formula (A), $R_{12}$ is a hydrogen atom, $R_{13}$ is a hydrogen atom, $Y_1$ is ←CONH— or ←CH(OH)$CH_2$O—, Z is an atomic group forming an imidazole ring, and X is a chlorine atom.

6. The dye-fixing element according to claim 1, wherein, in the formula (B), $R_{22}$ is a hydrogen atom, $R_{23}$ is a hydrogen atom, and $Y_2$ is ←CONH—.

7. A method for forming an image comprising subjecting a photosensitive silver halide to development after imagewise exposure, releasing or producing an image-forming dye or a precursor thereof in proportion or in contraproportion to the developed silver, and forming an image by diffusion or diffusive transfer of the dye, wherein a dye-fixing element is used, in which the dye-fixing element comprises a polymeric dye mordant containing a recurring unit represented by the following formula (A) and/or a recurring unit represented by the following formula (B):

formula (A)

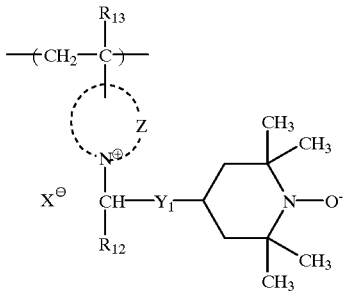

-continued formula (B)

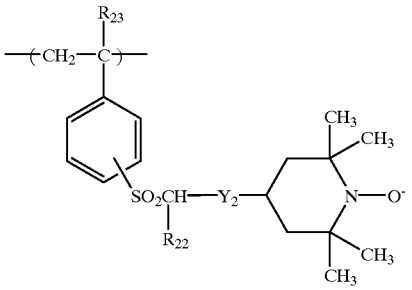

wherein $R_{12}$ and $R_{22}$ each stand for a hydrogen atom or an alkyl group, $Y_1$and $Y_2$ each stand for ←$CONR_4$—, ←COO— or ←CH(OH)$CH_2$O—, X stands for a chlorine atom, a bromine atom, an iodine atom or a hydroxyl group, Z stands for an atomic group necessary for forming a 5- to 7-membered hetero ring together with the nitrogen atom, $R_{13}$ and $R_{23}$ each stand for a hydrogen atom, a methyl group, an ethyl group, or a halogen atom, and $R_4$stands for a hydrogen atom or an alkyl group having 1 to 4 carbon atoms, and wherein ← stands for a bond on the side of a main chain of the polymer.

8. The method for forming an image according to claim 7, wherein a photosensitive material and/or the dye-fixing element is incorporated with a base or a precursor thereof and the material and the element are overlapped each other with a small amount of water and heated after imagewise exposure, thereby effecting the development.

9. The method for forming an image according to claim 7, wherein the dye-mordant contains the recurring unit represented by the formula (A) and/or the recurring unit represented by the formula (B) in an amount of at least 0.5 mol % based on the total recurring unit being 100 mol %.

10. The method for forming an image according to claim 7, wherein the dye-mordant is represented by the following formula (C):

formula (C)
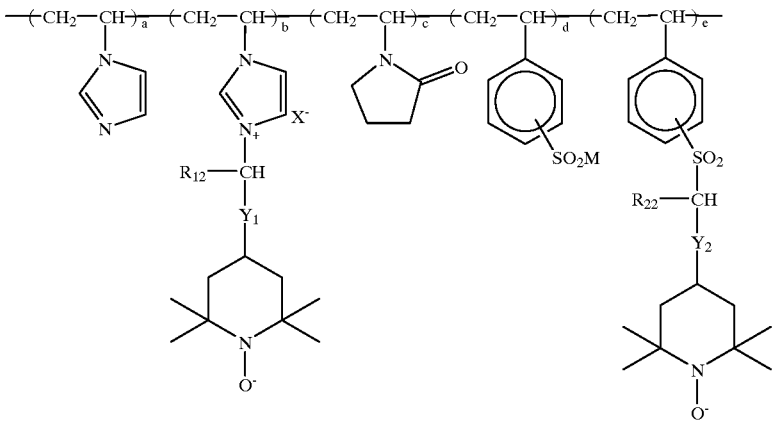
wherein $Y_1$, $Y_2$, $R_{12}$, $R_{22}$ and X have the same meanings as defined in the formulas (A) and (B), M stands for an alkali metal ion, a is 50–99 mol %, a total of b and e is 1–10 mol %, c is 0–49 mol %, and d is 0–10 mol %, with the proviso that a, b, c, d, and e are so selected that the total becomes 100 mol %.
* * * * *